United States Patent [19]

Schienda et al.

[11] Patent Number: 4,930,604

[45] Date of Patent: Jun. 5, 1990

[54] ELEVATOR DIAGNOSTIC MONITORING APPARATUS

[75] Inventors: Gregory A. Schienda, Southington; Mark L. Mayfield, Bristol, both of Conn.

[73] Assignee: United Technologies Corporation, Hartford, Conn.

[21] Appl. No.: 264,566

[22] Filed: Oct. 31, 1988

[51] Int. Cl.[5] ..... B66B 3/00

[52] U.S. Cl. ..... 187/133

[58] Field of Search ..... 187/101, 130, 133

[56] References Cited

U.S. PATENT DOCUMENTS

| | | | |
|---|---|---|---|
| 3,973,648 | 8/1976 | Hummert et al. | 187/133 |
| 4,330,838 | 5/1982 | Yoneda et al. | 364/580 |
| 4,397,377 | 8/1983 | Husson et al. | 187/101 X |
| 4,418,795 | 12/1983 | Trosky et al. | 187/130 |
| 4,458,788 | 7/1984 | LePore | 187/133 |
| 4,561,093 | 12/1985 | Doane et al. | 371/20 |
| 4,568,909 | 2/1986 | Whynacht | 340/21 |
| 4,622,538 | 11/1986 | Whynacht et al. | 340/506 |
| 4,698,780 | 10/1987 | Mandel et al. | 187/130 |
| 4,750,591 | 6/1988 | Coste et al. | 187/130 |
| 4,823,914 | 4/1989 | McKinney et al. | 187/133 |

*Primary Examiner*—A. D. Pellinen
*Assistant Examiner*—W. E. Duncanson, Jr.
*Attorney, Agent, or Firm*—Richard H. Kosakowski

[57] ABSTRACT

Apparatus is connected by way of a serial communication link to at least one computer-based elevator controller in order to monitor the diagnostic output of each connected controller. The diagnostic output of a controller is determined in a manner by which the elevator system is modeled as normally operating sequentially from state to state in a closed loop sequence of linked operating states. Any deviations from this sequence generate diagnostic messages that are communicated from the controller to the monitoring apparatus. Also communicated are the last to occur of a plurality of parameter signal state changes. The monitoring apparatus processes the diagnostic signals for visual and/or hard copy display to interested elevator personnel in a meaningful way. Further, the monitoring apparatus provides a plurality of signals to the elevator controller indicative of corresponding reference standards that the elevator controller utilizes in determining the occurrence of certain elevator event conditions.

10 Claims, 6 Drawing Sheets

FIG. 3

CAR ID 702696

POR MESSABLE ENABLE (YES=1, NO=0) 0 EVENT BUFFER W/ALERTS (YES=1, NO=0) 1

NUDGE THRESHOLD 4 EXCESSIVE DOOR CLOSE CYCLES 5

ALERT THRESHOLD 4

ONE-FLOOR RUN: TIME 15 SEC START LANDING 1 END LANDING 2

TIMER LIMITS (ALL VALUES IN SECONDS):

| | | | | | |
|---|---|---|---|---|---|
| F DOOR CLOSE | 10 | R DOOR CLOSE | 10 | RUN CYCLE | 120 |
| F DOOR OPEN | 10 | R DOOR OPEN | 10 | DECELERATION | 10 |
| F DOOR CYCLE | 140 | R DOOR CYCLE | 240 | EMERG. BUTTON | 120 |

NO CAR RESPONSE 240 GROUP COMM DELAY 260

FIG. 4

```
CAR MONITORING SYSTEM                          SITE: DEFAULT
                                                     THIS IS THE DEFAULT
                                                     SITE FILE.
Thu  4-JUN-1987  1:00:00 PM                    BLDG: SHERLOCK

F1 : SELECT SITE CONFIGURATION FILE            PRINT INCOMING MESSAGES
F2 : FLUSH SYSTEM OF STORED INFORMATION        SF1 : ENABLED
F3 : POLL ECS FOR INFORMATION
F4 : REQUEST EVENT BUFFER FROM ECS             REQUEST PERFORMANCE DATA
F5 : DISPLAY SAVED INFORMATION FILES           SF1 : ENABLED
F6 : DELETE INFORMATION FILES FROM DISK
F7 : UPDATE DATA DISK SPACE
F8 : FORMAT NEW DATA DISK
F9 : RESET PRINTER
F10: SHOW CONFIGURATION FILE INFORMATION

CTRL END : EXIT CAR MONITORING SYSTEM

SYSTEM STATUS : WAITING FOR USER INPUT...      REMAINING DISK SPACE : 100%
```

FIG. 5

EVENTS -- SITE: TRUMPC CAR: 1 BLDG: NPA80656 15:20 07-17-1987
CODE: 219 Elevator Type: ELEVONIC

| | | | | |
|---|---|---|---|---|
| *MLS 20 | MLS21 | DFO make | *Drop DO | DFO break |
| FDoor closing | *Run off | *MLS 3 | MLS 4 | MLS 5 |
| MLS 6 | *MLS 8 | DST on | *DFC make | GDS on |
| *FDoor closed | RUN on | IDZPPT off | MLS 1Ø | *ODZ off |
| SP 5 | *SCC on | SP 6 | *SP 7 | Pull DO |
| *ODZ on | DFC break | DST off | *IDZPPT on | *FDS off |
| MLS 14 | *MLS 2Ø | DFO make | *MLS 21 | Drop DO |
| *DFO break | *FDoor closing | RUN off | MLS 3 | *MLS 4 |
| MLS 5 | *MLS 6 | MLS 9 | *dfc make | *DST on |
| GDS on | FDoor closed | *RUN on | *MLS 11 | IDZPPT off |
| *ODZ off | SP 6 | *SCC on | SP 5 | *SP 4 |
| Pull DO | ODZ on | *IDZPPT on | DFC break | *GDS off |
| MLS 15 | *DST off | DST on | *MLS 2Ø | MLS 21 |
| *Stop car | *MLS Ø | RUN off | Lev down on | DFO make |
| *Drop DO | Pull DO | *DODIS on | | |

```
CODE: 112   SITE: TRUMPC   CAR: 1      BLDG: NPA89656  15:21   Ø7-17-1987

Car not responding at landing: 4.
Car motion INHIBITED.  MODE 13.  BNP ON.
```

```
CODE 112:  ELEVATOR NOT RESPONDING TO MOTION COMMANDS

A. EXPLANATION:   Elevation disposition determined from processor inputs:
                  inductors, software signal safe (car motion inhibted is
                  safe =Ø, software commands to UMV, ULV, DMV, DLV, and/or
                  door open command.

B. CAUSES:        1. If elevator running down when problem occurs and condition
   (HYDRAULIC)       resolves in short time, check for pump motor stuck on.
                     Excessive deceleration time alert may precede alarm
                     during this condition.
                  2. If stall protection or car motion inhibited check: hoistway
                     lock, TES, PES, EEC, GS not made, DR relay coil, plunger
                     steadier switch, low oil switch and/or L4S, L6S, L8S.

   (ELEVONIC)     1. Door operators
                  2. Safety chain
                  3. Loss of building power
                  4. Door locks not making or LVC123 not breaking if GDSFLG
                     is on
                  5. Software signal safe=Ø for period of time.

PRESS SPACEBAR TO EXIT EXPLANATION
```

FIG. 6

FIG. 7

```
DATA ---- SITE: TRUMPC    CAR: 1    BLDG: NPA80656    15:21 Ø7-17-1987

Front door operations.........ØØØØØ4   Rear door operations.........ØØØØØØ
Front door reversals..........ØØØØØ1   Rear door reversals..........ØØØØØØ
Front door nudges.............ØØØØØØ   Rear door nudges.............ØØØØØØ
Front door long close cycles..ØØØØØØ   Rear door long close cycles..ØØØØØØ

Number of runs................ØØØØØ4
Demand minutes................ØØØØØ2
Running minutes...............ØØØØØ1
Relevels......................ØØØØØ1
Time on independent service...ØØØØØØ

THE FOLLOWING APPLIES TO ELEVONIC ELEVATORS

Light runs up.................ØØØØØ2   Light runs down..............ØØØØØ2
Partial runs up...............ØØØØØØ   Partial runs down............ØØØØØØ
Full runs up..................ØØØØØØ   Full runs down...............ØØØØØØ

Low AC runs...................ØØØØØØ
```

ELEVATOR DIAGNOSTIC MONITORING APPARATUS

DESCRIPTION

Technical Field

This invention relates to apparatus for monitoring the diagnostic output of a computer-based system, and more particularly to such apparatus for use with a computer-based elevator controller possessing enhanced diagnostic capability.

BACKGROUND ART

As computer-based systems advance in sophistication and proliferate in number, associated service problems increase in novelty and number as well. Elevators provide a representative example. In the prior art, elevator problems that exist at the time a service technician requests this information can be extracted by an Operator's Maintenance Tool (OMT), as disclosed in U.S. Pat. No. 4,561,093 to Doane et al. With the OMT, a user must either ask the elevator controller for the diagnostic status, or command the elevator to operate in an attempt to duplicate and identify the problem. This works well for simplistic elevator control problems However, for more complex elevator problems, it is often required to install a complex and expensive logic state analyzer on the computer-based elevator controller to diagnose the aforementioned problems. However, the analyzer must be operated by a person knowledgeable with the control software of the elevator controller. Normally, this is not the elevator service technician.

To solve this problem, enhanced elevator diagnostics were developed. Commonly-owned U.S. Pat. No. 4,750,591 to Coste et al. discloses a method and apparatus for monitoring an elevator by utilizing signals available within the elevator itself to determine the identity of an elevator car operating state. That art is predicated on the fact that an elevator car normally operates sequentially from state to state in a closed loop sequential chain of linked normal operating states. As a result, selected message signals are provided in the presence of state transitions to either normal or abnormal operating states. These selected message signals are intended to be transmitted to external monitoring apparatus at the elevator site.

DISCLOSURE OF THE INVENTION

Objects of the invention include extracting and recording enhanced diagnostic information from a computer-based elevator controller and conveying the diagnostic information to interested personnel in a meaningful way.

According to the present invention, a plurality of signals indicative of enhanced diagnostic information of an elevator system that normally operates sequentially from state to state in a closed loop sequence of linked operating states are communicated from at least one computer-based elevator controller to signal processing means operable to process the diagnostic signals for visual and/or hard copy display to interested elevator personnel in a meaningful way.

In further accord with the present invention, the signal processing means provide a plurality of signals to the elevator controller indicative of corresponding reference standards that the elevator controller utilizes in determining the occurrence of certain elevator event conditions.

Other objects, features, and advantages of the present invention will become more apparent in light of the following detailed description of exemplary embodiments thereof, as illustrated in the accompanying drawing.

BRIEF DESCRIPTION OF DRAWING

FIG. 3 illustrates a computer screen for display of a plurality of typical elevator parameters.

FIG. 4 illustrates a computer screen for display of an exemplary main menu for the monitoring program.

FIG. 5 illustrates a computer screen of the typical contents of an elevator controller event buffer as a result of an alarm or alert condition.

FIG. 6 illustrates a computer screen associated with an alarm display along with an optional detailed description of the alarm and the possible causes for it.

FIG. 7 illustrates a computer screen associated with typical elevator performance data collected during polling of the elevator controller.

BEST MODE FOR CARRYING OUT THE INVENTION

Figure 1:
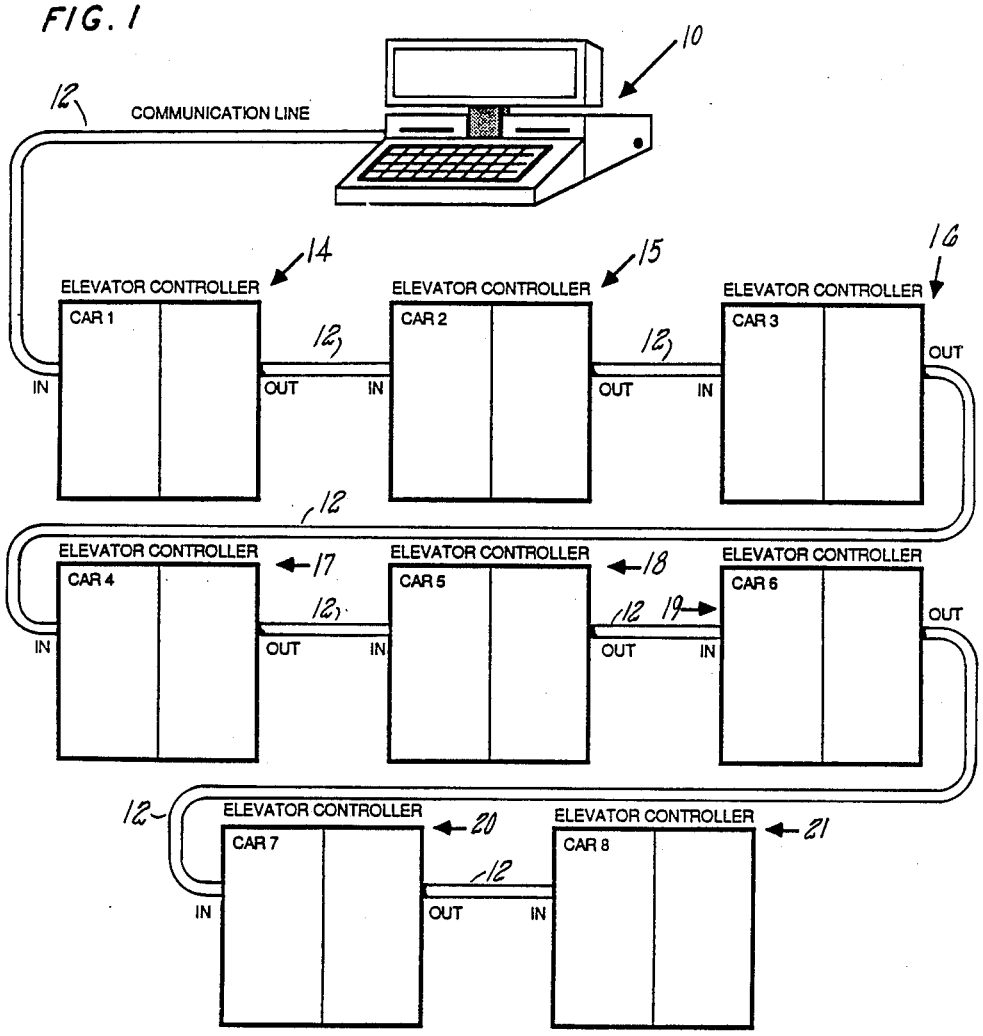
FIG. 1 illustrates a computer of the invention connected, by means of a serial communication link, to eight computer-based, elevator controllers, each of which has enhanced diagnostic capability.

In FIG. 1, a computer 10 is connected by means of a serial communication link 12 to eight computer-based, elevator controllers 14—21. The computer 10 is typically an International Business Machine Corporation (IBM) laptop personal computer or one of a number of other manufacturer's computers similar to that of IBM (i.e., IBM "clones"). The communication link 12 is typically that of the well-known RS422 industry standard.

Each elevator controller 14–21 contains software that controls the operation of the elevator car and also implements enhanced elevator diagnostics as disclosed in the aforementioned commonly-owned U.S. Pat. No. 4,750,591 to Coste et al, all of which is incorporated herein by reference. There, a method and apparatus for monitoring an elevator is disclosed in which the elevator car is modeled as operating in a closed loop chain of normal operating states. The controller monitors the states of a plurality of two-state parameter signals, each signal being indicative of one of a corresponding plurality of elevator parameters. The identity of a car operating state is determined by detecting the satisfaction of a criterion defining a transition either from an immediately preceding operating state or to an immediately succeeding operating state. The transition detection is accomplished by detecting the parameter signal state or states, alone or in combination, of one or more of the sensed parameter signals that define the satisfied transition criterion, each criterion indicating either a transition to a normal operating state in the sequence of states or to an abnormal operating state. The elevator controller provides selected message signals in the presence of corresponding selected transitions. A selected number of the most recent to occur of certain parameter signal state changes are stored in an event buffer and provided as part of the selected message signals.

As a result of the monitoring of elevator operation, the controller software records significant parameter signal state changes and analyzes these changes for indication of performance data, alarms, and alerts. Such analysis provides error recognition by comparing actual event sequences to predefined valid event sequences that are normal to elevator control. Deviations from the pre-defined sequences invoke the alarm condition, alert condition, and some system usage accounting messages. Other system usage accounting messages are integral to normal event sequences. Performance data consists of data such as number of runs and number of door operations. An alarm message is associated with certain shutdown conditions where a passenger may be trapped in the car. An alert message is an indication that the elevator is operating below performance standards.

Also provided as a part of alarms and alerts are the contents of an event buffer, located inside the controller, that stores the last one hundred or so significant events (i.e., significant parameter signal state changes) leading up to the reported alarm or alert condition. The storing of the last one hundred events monitored is particularly advantageous for trouble shooting purposes.

Monitoring an elevator car according to an operating state model together with storing the most recent of selected event occurrences provides a powerful method of diagnosing elevator problems.

In an exemplary embodiment of the aforementioned Coste et al patent, the monitoring of an elevator system according to the state machine model is accomplished by a computer-based elevator controller. Once transition-significant parameter signals are detected and recorded by the controller, they are analyzed for the presence of significant events such as alarm conditions, sub-standard performance conditions (alerts), and system usage performance conditions. Diagnostic messages indicative of these conditions are then communicated outside of the particular controller to the computer 10 for manifestation to elevator personnel. Communication of diagnostic messages indicative of problem conditions to an external computer provides an improved method of troubleshooting computer-based elevator controllers.

Figure 2:
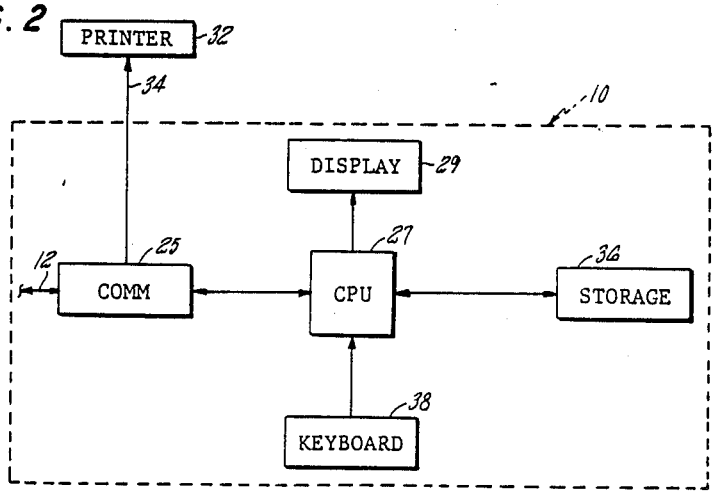
FIG. 2 is a block diagram of the computer of FIG. 1.

FIG. 2 is a block diagram of the computer of FIG. 1. The communication link 12 connecting the elevator controllers 14–21 together is also connected to communication means 25 inside the computer 10. The communication means 25 is typically implemented with readily-available dedicated digital line driver and receiver integrated circuits marketed by well-known companies such as Texas Instruments or Motorola. The communications means 25 is used to receive the messages indicative of enhanced elevator diagnostic information transmitted over the communication line 12 from any one of the elevator controllers 14–21. Once received, the communication means 25 decodes the message signals and provides signals indicative of the decoded messages to a central processing unit (CPU) 27. The CPU is typically implemented with any well-known microprocessor integrated circuit (IC), such as the Intel Model 80188 microprocessor, together with optional support ICs (e.g., interrupt controller, direct memory access controller, etc.).

Table III of the aforementioned Coste et al patent, incorporated herein as Table I, lists exemplary messages transmitted to the computer 10 in response to the diagnosis of certain elevator conditions. For example, assume a typical sequence of elevator operating states (reference FIG. 4(a) of the the aforementioned Coste et al patent) where the elevator car has stopped at a landing, the doors are closed, and a door open command has been received by the elevator controller. The reception of the door open command transitions the elevator controller software to proceed from a no door open command state (S0) to a state (S1) where the doors are opening and the door fully closed parameter signal is off. The next normal operating state (S2) is that of the condition where the doors are partially open and are continuing to open in response to the door open command. Once the doors are fully open, a transition is made to a state (S3) indicative of the doors being fully open and the elevator controller is anticipating a door close command.

TABLE I

| | | SHUTDOWN MESSAGES (TYPE 01) | | | | |
|---|---|---|---|---|---|---|
| SUB-TYPE | DEFINITION | DATA WORD 1 | DATA WORD 2 | DATA WORD 3 | DATA WORD 4 | DATA WORD 5 |
| 1 | Trapped passenger | Committable landing | Car at landing | Car stall protect | REM state | Safe |
| 2 | Trapped passenger malfunction doors | Committable landing | Car at landing | Car stall protect | REM state | Safe |
| 3 | Stalled car | Committable landing | Car at landing | Car stall protect | REM state | Safe |
| 4 | Stalled car malfunction doors | Committable landing | Car at landing | Car stall protect | REM state | Safe |
| 5 | Stalled car door stuck | Committable landing | Car at landing | Car stall protect | REM state | Safe |
| 6–10 | Condition resolved back in service | Committable landing | Car at landing | Car stall protect | REM state | Safe |
| 11 | Back in service by power cycled | TSK000 | INT000 | STRT00, STRT01 | LST000, LST001 | STACK POINTER |
| 12 | Car not responding | Committable landing | Car at landing | Car stall protect | REM state | Safe |
| 13 | Trapped passenger car not responding | Committable landing | Car at landing | Car stall protect | REM state | Safe |
| 14 | Frequent safety | Committable landing | Car at landing | Car stall protect | REM state | Safe |

TABLE I-continued

| | | | | | | |
|---|---|---|---|---|---|---|
| | chain failures | | | | | |
| 15 | Frequent door open failures | Committable landing | Car at landing | Car stall protect | REM state | Safe |
| 16 | ECS not running (generated by external computer) | Committable landing | Car at landing | Car stall protect | REM state | Safe |
| 17 | REM buffer overrun | Committable landing | Car at landing | Car stall protect | REM state | Safe |
| 18 | Operator interrupt | Committable landing | Car at landing | Car stall protect | REM state | Safe |

MAINTENANCE MESSAGES (TYPE 02)

| SUB-TYPE | DEFINITION | DATA WORD 1 | DATA WORD 2 | DATA WORD 3 | DATA WORD 4 | DATA WORD 5 |
|---|---|---|---|---|---|---|
| 1 | Deceleration time limit exceeded | Number of occurrences | Limit | Last failure time | Landing of last occurrence | |
| 2 | Exessive nudges | Number of occurrences | Number of nudges | Number door operations | Limit | |
| 3 | Door close time limit | Number of occurrences | Limit | Last failure time | Landing of last occurrence | |
| 4 | Excessive nudges exceeded | Number of occurrences | Number of nudges | Number door operations | Limit | |
| 5 | Rear close time limit exceeded | Number of occurrences | Limit | Last failure time | Landing of last occurrence | |
| 6 | Run time between landings exceeded | Number of occurrences | Limit | Last failure time | First landing | Second landing |
| 28 | High pit oil | Number of occurrences | | | | |
| 29 | Spare | | | | | |
| 30 | Door open time limit exceeded | Number of occurrences | Limit | Last failure time | Landing of last occurrence | |
| 31 | Rear open time limit exceeded | Number of occurrences | Limit | Last failure time | Landing of last occurrence | |
| 32 | Failure of doors to open detected | Number of occurrences | Landing of last occurrence | REM state | Emergency stop | |
| 33 | Failure of rear doors to open detected | Number of occurrences | Landing of last occurrence | REM state | Emergency stop | |
| 34 | Malfunction door switches | Number of occurrences | Landing of last occurrence | REM state | Emergency stop | |
| 35 | Spare | | | | | |
| 36 | Rear lock bounce | Number of occurrence | Landing of last occurrence | | | |
| 37 | Front lock bounce | Number of occurrences | Landing of last occurrence | | | |
| 38 | Safety chain break | Number of occurrences | Landing of last occurrence | | | |
| 39 | Run aborted | Number of occurrences | Landing of last occurrence | REM state | Emergency stop | Motion detected |
| 40 | Invalid change in committable position | Number of occurrences | Landing of last occurrences | | | |
| 41 | Invalid inductor sequence | Number of occurrences | Landing of last occurrence | REM state | | |

PERFORMANCE DATE (TYPE 03)

| SUB-TYPE | DEFINITION | DATA WORD 1 | DATA WORD 2 | DATA WORD 3 | DATA WORD 4 | DATA WORD 5 |
|---|---|---|---|---|---|---|
| 1 | Front door information | Front door operations | Front door reversals | Front door nudges | Front door close exceedances | |
| 2 | Rear door/ information | Rear door operations | Rear door reversals | Rear door nudges | Rear door close exceedances | Number of runs |
| 3 | Run information | Demand minutes | Running minutes | Relevels | | |

TABLE I-continued

| | | | | | |
|---|---|---|---|---|---|
| 4 | For elevonic | Empty runs up | Empty runs down | Partial runs up | Partial runs down |
| 5 | For elevonic | Full runs up | Full runs down | | |

Upon receiving a door close command, a transition is made to a state (S4) in which the doors are partially open and are closing in response to the close command. Once the doors are fully closed and no door open command is present, a transition is made to a corresponding state (S5). Then, when a door open command is received, a transition is made to the state (S1) in which the door open command has been received and the door fully closed parameter signal is off. This closed loop sequence of normal car door operating states is the expected sequence for a normally operating elevator car.

Connected with certain ones of the state transitions are output functions performed by the elevator controller. For example, upon the transition from state S0 to state S1, a timer, implemented either in hardware or software, would have been started. Then, from the time the door open command is received in state S0, through intermediary states S1 and S2, until the time the door fully open condition is sensed in state S3, the timer is in operation. Once state S3 is reached, the timer value is compared to a preselected time limit for door opening. If the time limit is exceeded, then the elevator controller sends a selected maintenance request message over the communication link 12 to the communication means 25 inside the computer 10. For the particular situation just described, maintenance message sub-type number thirty (reference Table I) is sent. Also, additional data words are transmitted, such as the number of occurrences of this particular time limit exceedence along with information that describes the current time limit that the actual limit was compared against by the elevator controller, the last time that a failure occurred, and the landing of the last occurrence of a time limit exceedence. These transmitted data words indicative of enhanced elevator diagnostics are then processed by the CPU 27 either for display on a computer display 29 or for a hard copy printout generated by an externally-connected printer 32. For a laptop-type personal computer, the display 29 is typically implemented as an eighty-column by twenty-five-line character matrix using liquid crystal display technology. The printer 32 is connected by a communications link 34 to the communication means 25. The protocol used for printer communications is typically either that of the well-known RS232 serial type or that of the well-known Centronics parallel communications protocol. The printer can be that of a wide variety of well-known types (e.g., dot matrix, laser, etc.) made by a number of well-known manufacturers (Okidata, Epson, Toshiba, etc.). The data words transmitted over the communication link 12 from any elevator controller can also be stored in storage means 36 for future manipulation and reference. The storage means 36 are typically comprised of several types of electronic storage media: volatile random access memory (RAM) for temporary storage and manipulation by the CPU 27; magnetic storage in the form of floppy disk for non-volatile, transportable storage; magnetic hard disk storage for non-volatile, high-volume storage.

Normally, the apparatus of the present invention is intended to be used either during system installation, for periodic evaluation, or for problem site analysis. A typical operating sequence is as follows: elevator maintenance personnel physically locate the computer 10 and, optionally, the printer 32 in the elevator machine room, or in close proximity thereto. The computer 10 is connected to up to eight computer-based elevator controllers 14–21 by way of the communication link 12. Typically, an IBM laptop personal computer is supplied with at least one communication port implementing the RS232 protocol, and at least one communication port implementing the Centronics parallel protocol. The optional printer 32 connects directly to either a Centronics parallel port or to one of the RS232 serial ports on the IBM computer 10. Since typically RS422 protocol electronics are not supplied on an IBM personal computer, a commonly available RS232-to-RS422 adapter is plugged into one of the RS232 ports on the IBM computer, and the RS422 cable implementing the RS422 communication link 12 is plugged into the adapter.

Once the computer and printer are connected to the elevator controllers, the software program that controls the operation of the computer 10 is loaded into the computer 10. Typically, the software is provided on a floppy disk which is placed into the system floppy disk drive (i.e., the "A" drive) on the IBM computer 10. Also, a data floppy disk is loaded into a second disk drive (i.e., the "B" drive) on the IBM computer 10. Electrical power is then applied to the computer 10 and printer 32.

After powerup, the software offers the user a choice between a configuration program or a monitoring program. The configuration program is normally run when it is desired to enter the parameters of the elevator installation, or if the user is unsure of the configurations on file, or if it is desired to edit a configuration file. The monitoring program is normally run when the configuration file for the particular elevator installation has been established and the user desires to extract information from any connected elevator controllers. All display of data to the user for subsequent interpretation and/or interaction is presented by way of the display 29.

The type of information normally entered when running the configuration program includes the site name, building number, number of cars, and the machine number of each car. This information is entered by the user using keystroke entries made on a keyboard 38 of the IBM computer 10.

Another feature of the configuration program is that, in the aforementioned door open/close sequence example, the current door open time limit, that the actual door opening time limit is compared against, is one of a plurality of predetermined parameter limit values that can be selected by the user. The user can choose to modify default values for the limits of a number of typical elevator operational parameters, as listed in Table II along with the corresponding parameter definitions. The chosen default values are entered interactively by the user using the keyboard 38 and display 29. FIG. 3 illustrates an exemplary computer screen containing a plurality of typical elevator parameters listed in Table II. The parameters which the user can set the current values of are enclosed in rectangles. The particular elevator controller uses the current values in determining certain elevator status conditions. These values are communicated by the computer 10 over the communication link 12 to the particular elevator controller when the monitoring program is entered.

Once the system configuration is complete, the monitoring program is entered wherein the enhanced elevator diagnostic information can be extracted from any of the computer-based elevator controllers 14–21 connected to the computer 10. The information is normally communicated to the computer at five hundred millisecond intervals. This transmission rate is strictly exemplary.

TABLE II

| Parameter | Definition |
|---|---|
| POR Message Enable | If enabled, an alarm is generated whenever car is powered up. |
| Event Buffer with Alert | If you enter "Y", the program will save the event buffer associated with each alert generated. |
| Nudge Threshold | Maximum allowable number of consecutive runs in which nudging is initiated. If this number is exceeded, a front door or rear door alert is generated. |
| Excessive Door Close Cycles | Maximum allowable number of instances of excessive door close time. If this number is exceeded, a front door or rear door alert is generated. |
| Alert Threshold | Maximum allowable number of occurrences of any one alert. If this number is exceeded, an alarm is generated. |
| One-Floor Run | Maximum time allowed for Time monitored one-floor run from "start landing" to "end landing". If time exceeds given value, an alert will be generated. |
| One-Floor Run Start Landing | Start landing for monitored one-floor run. |
| One-Floor Run End Landing | End landing for monitored one-floor run. |
| F Door Close | Maximum time allowed for the front doors to close. If actual time exceeds this limit, the Excessive Front Door Close counter is incremented. |
| R Door Close | Maximum time allowed for the rear doors to close. If actual time exceeds this limit, the Excessive Rear Door Close counter is incremented. |
| F Door Open | Maximum time allowed for the front doors to open. If actual time exceeds this limit, an alert is generated. |
| R Door Open | Maximum time allowed for the rear doors to open. If actual time exceeds this limit, an alert is generated. |
| Deceleration | Maximum time allowed for a hydraulic elevator to make a stop. If this time is exceeded, an alert is generated. |
| F Door Cycle | Maximum time allowed for the front doors to go through a complete cycle of operation. If actual time exceeds this limit, an alarm is generated. |
| R Door Cycle | Maximum time allowed for the rear doors to go through a complete cycle of operation. If actual time exceeds this time, an alarm is generated. |
| Run Cycle | Maximum time allowed for car to complete a run. If actual run time exceeds this limit, an alarm is generated. |
| No Car Response | Maximum time allowed for clearance of a static door failure (i.e., failure of doors to open, failure of hoistway door interlocks to make, or door-related software shutdowns). If trouble is not cleared within the timer limit, an alarm is generated. |
| Emergency Button | Maximum time allowed for "No Car Response" if the in-car Emergency Stop button is pushed when initial problem is detected. |
| Group Comm | Maximum time allowed from Delay detection of a group communication failure, until failure is cleared. If trouble is not cleared within the timer limit, an alarm is generated. |

After entering the monitoring program, a main menu appears on the display screen 29, as illustrated in FIG. 4. This menu lists the options available to the operator for extracting, recording, or conveying enhanced elevator diagnostic data. The software for the computer 10 is designed such that most selections are entered with single keystrokes. For example, upon initially entering the monitoring program, the user typically depresses the function key "F1" in order to select, from a list that appears on the screen, the desired site configuration file developed hereinbefore in the configuration program. This single keystroke entry facilitates ease of operation.

After the user has chosen the proper site configuration file, program operation is returned to the main menu. At this point, the user typically extracts data from an elevator controller by one of two methods: if the currently stored historical data in the elevator controller may be of some value in diagnosing a reported problem (e.g., due to an elevator malfunction reported by building personnel), then the user selects "F3" in order to poll the elevator control system (ECS) for such information; if the meaning of the data is unknown (of no interest), then the user selects "F2" in order to "flush" (erase) data from the controller. After selecting the flush option, the user can either save the flushed data on the floppy disk portion of the storage means 36 for future interpretation or the data can be discarded. Also in the flush option, the number of alarm or alert conditions received for each elevator car controller from which data is flushed is indicated on the display 29.

If it is desired to poll the system for current data (i.e., real time operation), the user should first flush the elevator controller of stored data and then begin polling the controller for current data. As a result of the polling operation, the screen displays the various operational functions (e.g., mode, motion, status of emergency button, car position, group status, etc.) of the polled elevator car, and will indicate whether alarms or alerts exist for the car. Data transmitted from an elevator controller to the computer 10 during the polling operation is saved in the storage means 36 for further interpretation, if desired.

The elevator controller communicates the contents of the controller event buffer to the computer 10 if the result of either the polling or flush operations indicate alarm or alert conditions. FIG. 5 illustrates a computer screen of the typical contents of a controller event buffer as a result of an alarm or alert condition. Listed are the latest to occur state changes of a number of typical elevator parameters that are monitored by the elevator controller.

Once the contents of the elevator controller have been either flushed or polled and subsequently saved in the storage means 36, the user is presented with several options for viewing the resulting saved data. By selecting option "F5" from the main menu, the user can display the various types of information transmitted by an elevator controller to the computer 10. For example, either alarms, alerts, and event buffers or, alternatively, performance data can be displayed on the display 29, or routed to the printer 32 for a hard copy printout. The computer screen (FIG. 5) illustrating event buffer contents associated with resultant alarm or alert conditions has been discussed hereinbefore. However, it is also possible to display the contents of the event buffer regardless of the presence of alarms or alerts. This saves time in that it allows one event buffer for one car controller to be displayed without first performing either the flush or poll procedure and paging through the resulting event buffers for the data associated with each car controller.

As a second option, the user can display alarms or alerts together with corresponding causes for either the alarm or alert. FIG. 6 illustrates a computer screen associated with an alarm display along with an optional detailed description of the alarm and the possible causes for it. The display for the alert condition is similar.

Also, the user can display elevator performance data collected during polling. Performance data associated with any elevator car is normally saved at the end of the polling session. FIG. 7 illustrates a computer screen associated with typical elevator performance data collected during polling of the elevator controller. As with alarms, alerts, and event buffers, performance data can also be printed out.

The software which controls the primary computer functions of communicating with the elevator controllers 14–21 over the communication link 12, communicating with the printer 32 via either an RS232 serial interface of a Centronics parallel interface, interacting with the user via the keyboard 38, storing the signals indicative of enhanced elevator diagnostic information in memory 36, and processing the display screens of the display 29 is implemented in a well-known manner that should be readily apparent to those skilled in the art in light of the teachings presented herein. A manufacturer such as IBM makes available to the public information regarding the interfacing with the computer's disk operating system (DOS) software for performing functions such as those enumerated above. The computer software that interfaces with the IBM DOS can be written in a designer's choice of a variety of commonly-available computer languages (e.g., Pascal, C, Assembler, etc.) made available either by IBM itself or one of a variety of third-party vendors.

Although the present invention has been described in detail in connection with the method and apparatus for monitoring an elevator as embodied in a computer-based elevator controller and disclosed in the aforementioned Coste et al patent, it is to be understood that the present invention can be utilized in any type of elevator system which normally operates sequentially from state to state in a closed loop sequential chain of linked normal operating states, which system determines the identity of an operating state by detecting the satisfaction of a criterion defining a transition from an immediately preceding operating state or to an immediately succeeding operating state by detecting the system parameter signal state or states, alone or in combination, of one or more sensed system parameter signals defining the satisfied transition criterion, each criterion indicating either a transition to a normal operating state in the chain or to an abnormal operating state, and which system provides selected message signals in the presence of corresponding selected transitions.

As described, the communication link between the computer 10 and a plurality of elevator controllers 14–21 is implemented with the well-known RS422 communications protocol. However, any serial or parallel communications protocol can be used; the choice of protocol depends on criteria such as the physical environment and communication interfaces available on the system controllers and computers. Also, an IBM laptop personal computer is used to extract, record and convey the enhanced elevator diagnostic information from eight elevator controllers. However, any number of elevator controllers can be interconnected to any one of a number of well-known types of commercially available computers. Also, it is possible for one skilled in the art to design and build the apparatus of the present invention using commonly-available electronic components, or even custom-designed components such as gate arrays or programmable logic devices.

Although the invention has been illustrated and described with respect to exemplary embodiments thereof, it should be understood by those skilled in the art that the foregoing and various other changes, omissions and additions may be made therein and thereto, without departing from the spirit and scope of the invention.

We claim:

1. Apparatus for use with an elevator system having at least one car, comprising:

for each elevator car, signal processing means for monitoring the states of a plurality of two-state parameter signals indicative of a corresponding plurality of elevator parameters, said signal processing means determining the identity of an elevator operating state for an elevator car which normally operates sequentially from state to state in a closed loop sequential chain of linked normal operating states by detecting the satisfaction of a transition criterion defining a transition from an immediately preceding operating state or to an immediately succeeding operating state by detecting the parameter signal state or states, alone or in combination, of one or more sensed parameter signals defining the satisfied transition criterion, each criterion indicating either a transition to a normal operating state in the chain or to an abnormal operating state, and for providing selected message signals in the presence of corresponding selected transitions;

for each elevator car, an event buffer, responsive to a selected number of the latest to occur of selected parameter signal state changes, for storing state change signals indicative of said latest parameter signal state changes, said event buffer responsive to said selected message signals for providing related buffer message signals corresponding to said stored state change signals;

for each elevator car, communication means, responsive to said selected message signals provided by said signal processing means, for transmission thereof, and responsive to said buffer message signals provided by said event buffer, for transmission thereof; characterized by:

monitor communication means, responsive to each of said elevator car communication means, for decoding said transmitted selected message signals and providing decoded signals indicative thereof, and for decoding said transmitted buffer message signals and providing decoded signals indicative thereof;

user input means for providing signals indicative of parameter limit values corresponding to parameter value transition criterion for said plurality of parameters monitored by each one of said elevator car signal processing means;

display means responsive to said monitor signal processing means;

monitor signal processing means, responsive to said monitor communication means, for providing signals indicative of said decoded selected message signals to said display means for display in a predetermined form, and for providing signals indicative of said decoded buffer message signals to said display means for display in a predetermined form, said monitor signal processing means being responsive to said user input means for providing signals indicative of said parameter limit value signals to said display means for display in a predetermined form, and for providing said signals indicative of said parameter limit value signals to said monitor communication means for transmission.

2. The apparatus of claim 1, wherein said user input means comprises means for providing keyboard input of said plurality of signals indicative of parameter limit values corresponding to parameter value transition criterion for said plurality of parameters monitored by each one of said elevator car signal processing means.

3. The apparatus of claim 1, wherein said monitor signal processing means comprises means, responsive to said monitor communication means, for storing signals indicative of said decoded selected message signals and for storing signals indicative of said decoded buffer message signals.

4. The apparatus of claim 1, wherein said monitor communication means comprises means, responsive to said monitor signal processing means, for providing signals indicative of said selected message signals to a hardcopy printout device for printout in a predetermined form, and for providing signals indicative of said buffer message signals to a hardcopy printout device for printout in a predetermined form.

5. Apparatus for monitoring the diagnostic signal output of an elevator controller, the diagnostic signal output including selected message signals indicative of operating states of the elevator, each operating state determined by the controller upon satisfaction of a transition criterion defined by a predetermined logic state of each of one or more selected elevator parameter signals monitored by the controller, the diagnostic signal output also including event signals indicative of logic state change occurrences of any of the one or more selected elevator parameter signals monitored by the controller, said apparatus comprising:

user input means, for providing signals indicative of desired parameter limit values corresponding to a parameter value transition criterion for each of the one or more selected elevator parameter signals monitored by the controller;

display means, having a display screen for providing a visual display of information thereon; and monitor signal processing means, for providing signals indicative of said selected message signals to said display means for visual display on said display screen in a predetermined form, and for providing signals indicative of said event signals to said display means for visual display on said display screen in a predetermined form, said monitor signal processing means being responsive to said user input means for providing signals indicative of said desired parameter limit value signals to said display means for visual display on said display screen in a predetermined form, and for communicating said signals indicative of said parameter limit value signals to the elevator controller.

6. The apparatus of claim 5, wherein said user input means comprises means for providing keyboard input signals indicative of a desired value of each of said signals indicative of desired parameter limit values.

7. The apparatus of claim 5, wherein said monitor signal processing means further comprises means for storing signals indicative of said selected message signals and for storing signals indicative of said event signals.

8. A method of monitoring the diagnostic signal output of an elevator controller, the diagnostic signal output including selected message signals indicative of operating states of the elevator, each operating state determined by the controller upon satisfaction of a transition criterion defined by a predetermined logic state of each of one or more selected elevator parameter signals monitored by the controller, the diagnostic signal output also including event signals indicative of logic state change occurrences of any of the one or more selected elevator parameter signals monitored by the controller, said method comprising:

providing signals indicative of parameter limit values corresponding to a parameter value transition criterion for each of the one or more selected elevator parameter signals monitored by the controller;

displaying visually signals indicative of said parameter limit value signals in a predetermined form;

communicating said signals indicative of said parameter limit value signals to the elevator controller;

providing signals indicative of said selected message signals;

displaying visually said signals indicative of said selected message signals in a predetermined form;

providing signals indicative of said event signals; and displaying visually said signals indicative of said event signals in a predetermined form.

9. The method of claim 8, further comprising:

inputting by keyboard a desired value of each of said signals indicative of parameter limit values.

10. The method of claim 8, further comprising:

storing said signals indicative of said selected message signals;

storing said signals indicative of said event signals.

* * * * *

UNITED STATES PATENT AND TRADEMARK OFFICE

CERTIFICATE OF CORRECTION

PATENT NO. : 4,930,604

DATED : June 5, 1990

INVENTOR(S) : Gregory A. Schienda and Mark L. Mayfield

It is certified that error appears in the above-identified patent and that said Letters Patent is hereby corrected as shown below:

Cover Page, line [73], "United Technologies Corporation" should read --Otis Elevator Company--.

Signed and Sealed this

Tenth Day of March, 1992

*Attest:*

HARRY F. MANBECK, JR.

*Attesting Officer*

*Commissioner of Patents and Trademarks*